US005522772A

United States Patent [19]

Chenard et al.

[11] Patent Number: 5,522,772

[45] Date of Patent: Jun. 4, 1996

[54] PLAYGROUND TOY

[75] Inventors: Alain Chenard, Sennecey le Grand; Denis Obriot, Heuilley Cotton; Patrick Roustit, Dieding; Philippe Cervelle, Conflans, all of France

[73] Assignee: Compagnie Plastic Omnium, Lyons, France

[21] Appl. No.: 256,650

[22] PCT Filed: Nov. 12, 1993

[86] PCT No.: PCT/FR93/01111

§ 371 Date: Mar. 9, 1995

§ 102(e) Date: Mar. 9, 1995

[87] PCT Pub. No.: WO94/11073

PCT Pub. Date: May 26, 1994

[30] Foreign Application Priority Data

Nov. 13, 1992 [FR] France ..... 92 13676

[51] Int. Cl.[6] ..... A63G 13/08

[52] U.S. Cl. ..... 472/103; 472/104

[58] Field of Search ..... 472/95, 103, 104, 472/99; 297/195.11, 209; 248/624; 482/87, 90, 83

[56] References Cited

U.S. PATENT DOCUMENTS

| | | | |
|---|---|---|---|
| 2,978,245 | 4/1961 | Rempel | 272/52 |
| 2,996,298 | 8/1961 | Grosse et al. | 272/52 |
| 4,351,521 | 9/1982 | Erdos | 272/52 |
| 4,379,550 | 4/1983 | Petersen | 272/52 |
| 4,575,072 | 3/1986 | Russell | 272/52 |
| 5,294,174 | 3/1994 | Bigolin | 297/209 X |

FOREIGN PATENT DOCUMENTS

| | | | |
|---|---|---|---|
| 624306 | 7/1961 | Canada | 472/104 |

*Primary Examiner*—Kien T. Nguyen
*Attorney, Agent, or Firm*—Schweitzer Cornman & Gross

[57] ABSTRACT

A playground toy for a seated user, which toy includes a coil spring, the lower end of which spring is fixed to a device for anchoring the toy in the ground and the upper end of which spring is fixed to a three-dimensional structure for supporting the user. The user support includes a rigid reinforcement secured to a connection piece and also includes a stress-distribution piece, preferably frustoconical, at least partially set into a housing or onto a boss of corresponding shape formed in the three-dimensional structure.

8 Claims, 3 Drawing Sheets

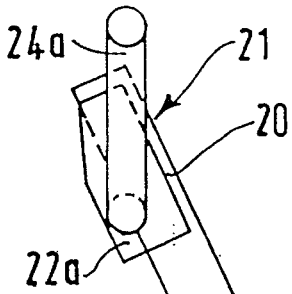
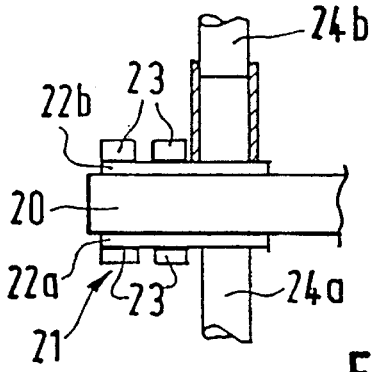
FIG. 4
FIG. 3
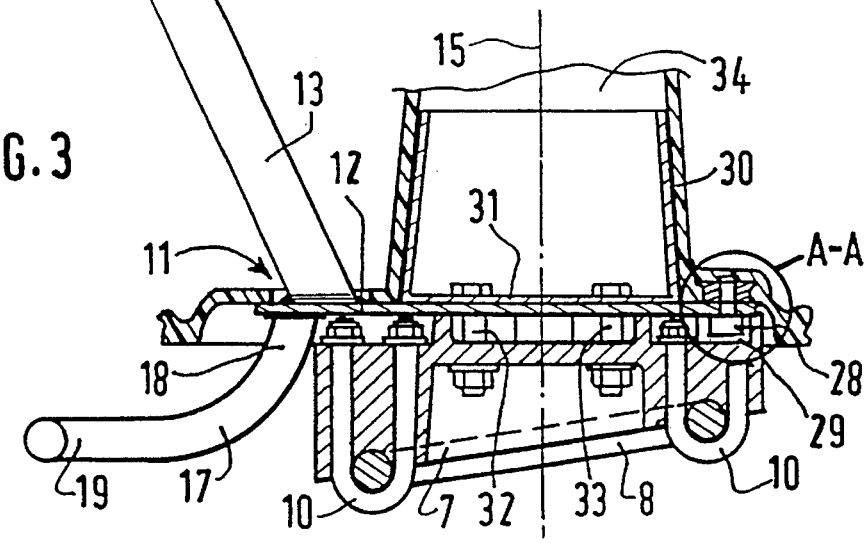
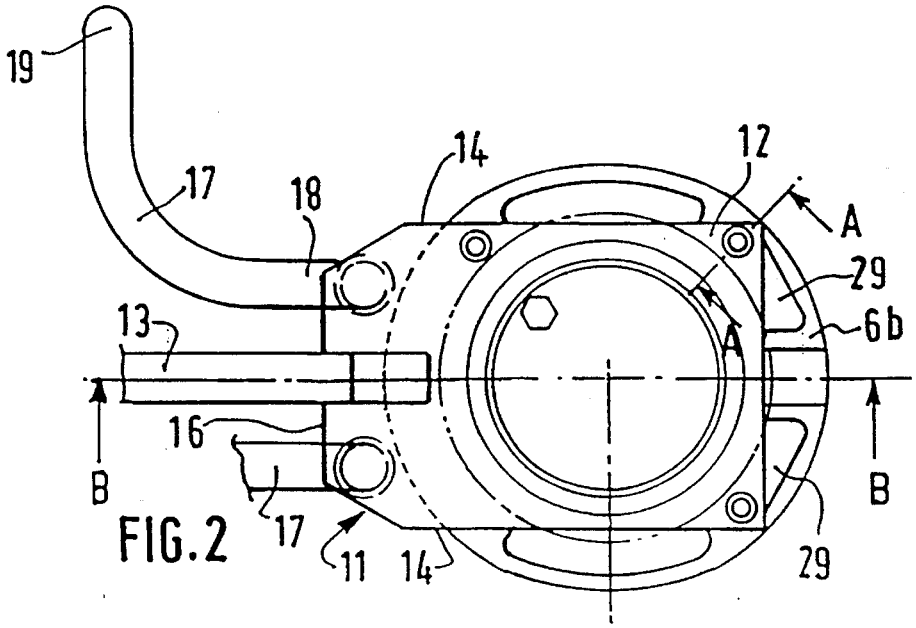
FIG. 2

PLAYGROUND TOY

BACKGROUND OF THE INVENTION

The present invention relates to a toy on a spring intended for playgrounds.

In general, toys on a spring comprise a structure made from metal, strong wood or hard plastic, which is fixed to a coil spring which is anchored in the ground, at its lower end. The users sit on this structure and can rock by virtue of the adequate lateral flexibility of the spring. The structure may assume the form of people or animals and be produced in flat form, the user sitting astride on a part forming a seat. The structure may also be produced as a three-dimensional structure.

The loads exerted by the user on the hand grips or the foot rests with which the structure is usually provided subject this structure to significant stresses. For this reason, after the toy on a spring has been used a certain number of times, cracks may appear on the structure particularly at the hand grips or the foot rests, as well as at the connection to the upper end of the spring.

To solve these problems of stresses rigid materials, such as metal or wood are used to produce the structure, the employment of which materials is complex and costly, particularly for three-dimensional structures.

It has also been proposed to produce structures from plastic such as polyethylene, but the operational stresses rapidly give rise to cracks and, in the case of polyethylene, to flow, which damages the structure and requires it to be replaced.

SUMMARY OF THE INVENTION

The object of the present invention is to produce a toy on a spring including a three-dimensional structure and in which the stresses exerted on the structure are reduced, thus making it possible to use plastics, particularly polyethylene, for manufacturing the structure.

The subject of the present invention is a toy on a spring including a coil spring, the lower end of Which is fixed to a device for anchoring in the ground and comprising a three-dimensional structure intended to support the user and which is fixed to the upper end of the coil spring by connection means, characterized in that it comprises, inside the three-dimensional structure, a rigid reinforcement secured to the said connection means and including a stress-distribution piece, preferably frustoconical, at least partially set into a housing or onto a boss of corresponding shape, formed in the three-dimensional structure.

According to the invention, the transverse and shear stresses induced by the oscillation of the spring are distributed over a large contact surface between the lateral wall of the distribution piece and the wall of the housing or of the boss and the risks of the three-dimensional structure cracking are substantially decreased.

According to another characteristic of the invention, the hand grips and the foot rests with which the toy on a spring is equipped are secured to the rigid reinforcement, which therefore absorbs the stresses generated by the loads exerted by the user for rocking.

In order best to distribute the stresses exerted on the distribution piece, the axis of the latter is parallel to that of the coil spring in its rest position, or preferably coincident with it.

Preferably, the three-dimensional structure is produced from plastic, for example from polyethylene.

The three-dimensional plastic structure may be produced as a single block, particularly by rotational moulding. In this case, the hand grips and/or the foot rests are produced so that they can be removed. Indeed, since the hand grips and/or the foot rests extend beyond the three-dimensional plastic structure and the rigid reinforcement lies inside the said three-dimensional structure, the said hand grips and/or the foot rests can be fixed to the rigid reinforcement only from outside the plastic structure. However, if the foot rests are fixed to the rigid reinforcement at the connection with the coil spring, the said foot rests may be secured to, and not removable from the rigid reinforcement, the three-dimensional structure being fitted over the foot rests.

According to another embodiment of the invention, the plastic structure may be produced by moulding two symmetrical blocks joined together around the rigid reinforcement. The hand grips and the foot rests may then be secured to and not removable from the rigid reinforcement.

Quite clearly, the three-dimensional plastic structure may be produced by any other conventional moulding process, for example, by injection or by extrusion/blow moulding.

To make the subject of the invention easier to understand, embodiments thereof, represented in the appended drawing, will be described hereafter by way of purely illustrative and non-limiting examples.

DESCRIPTION OF THE DRAWINGS

FIG. 2 is a plan view of the rigid reinforcement and of the connection piece according to an embodiment variant;

FIG. 3 is a section on B—B of FIG. 2 with a part in section on A—A of FIG. 2;

FIG.4 is a plan view of the connection between the hand grips and the rigid reinforcement of the embodiment of FIG. 3;

DETAILED DESCRIPTION OF THE INVENTION

Figure 1:
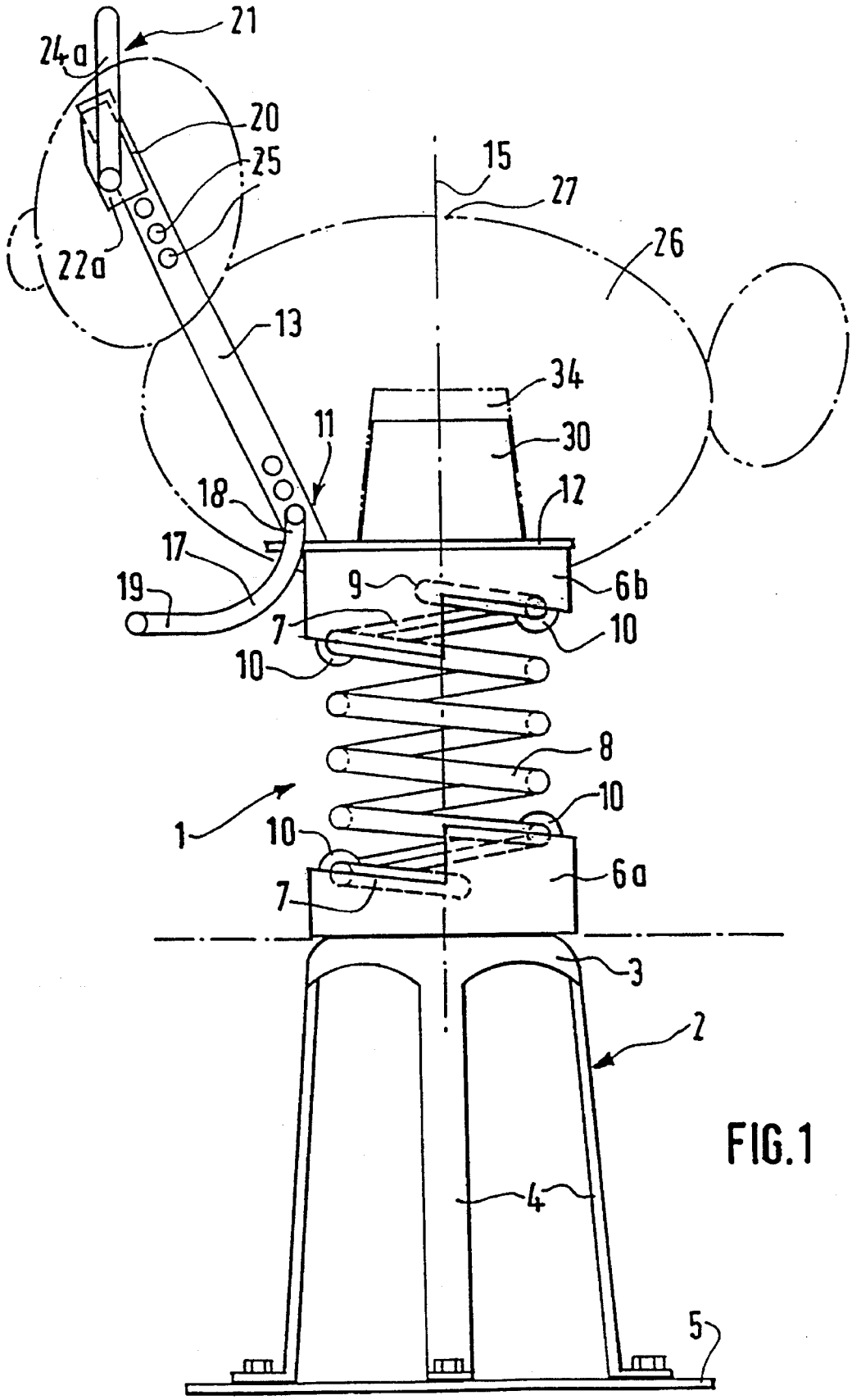
FIG. 1 is a diagrammatic side view of a toy on a spring according to the invention, equipped with its device for anchoring in the ground.

FIG. 1 represents a toy on a spring according to the invention, denoted overall by 1, including, in its lower part, an anchoring device 2. The anchoring device 2 comprises an anchoring stool piece 3 equipped with one or more legs 4 and one or more plates 5, for example a laminated structure, to which the said legs 4 are fixed. The anchoring device 2 is arranged so that the anchoring stool piece 3 is horizontal at ground level and the plates 5 are located a certain depth under ground. The invention is not, however, limited to the anchoring device 2 illustrated, which may be in other forms, for example in the form of a simple concrete slab at ground level.

A connection piece *6a* is fixed to the upper part of the anchoring stool piece 3. This connection piece *6a*, of substantially cylindrical shape in the example illustrated, includes an upper surface with helical profile equipped with a groove 7 capable of housing one turn of a coil spring 8. The connection piece *6a* includes a housing 9 for the lower end of the coil spring 8, the said housing 9 being vertically offset with respect to the surface of the connection piece *6a* which receives the adjacent turn of the coil spring 8. The coil spring 8 is fixed at the upper surface of the connection piece 6*a* into the groove 7 by U-bolts 10.

At the other end of the coil spring 8, the last turn of the latter is housed in a connection piece 6*b* of the same type as the previous one, the surface of helical profile of the connection piece 6*b* this time pointing downwards.

The toy on a spring according to the invention comprises a rigid reinforcement 11 including a lower horizontal plate 12 of substantially rectangular shape, as well as a branch 13 located in a median plane of the plate 12 parallel to the longest sides 14 of the said plate. The branch 13 is inclined with respect to the vertical axis 15 of the coil spring 8, in the rest position, and is fixed close to one of the short sides 16 of the rectangular plate 12.

The connection piece 6*b* into which the 4 upper end turn of the coil spring 8 is fixed, supports the rectangular plate 12 on its upper surface. The rectangular plate 12 extends with respect to the connection piece 6*b*, allowing the installation of two foot rests 17 which are fixed on either side of the branch 13 on the lower face of the rectangular plate 12. The foot rests 17 have, as is best seen in FIGS. 2 and 3, a curved shape with one end, 18, fixed, removably or otherwise, to the branch 13 (FIG. 1) or to the plate 12 (FIGS. 2 and 3), and one free end 19 extending away from the branch 13.

Figure 5:
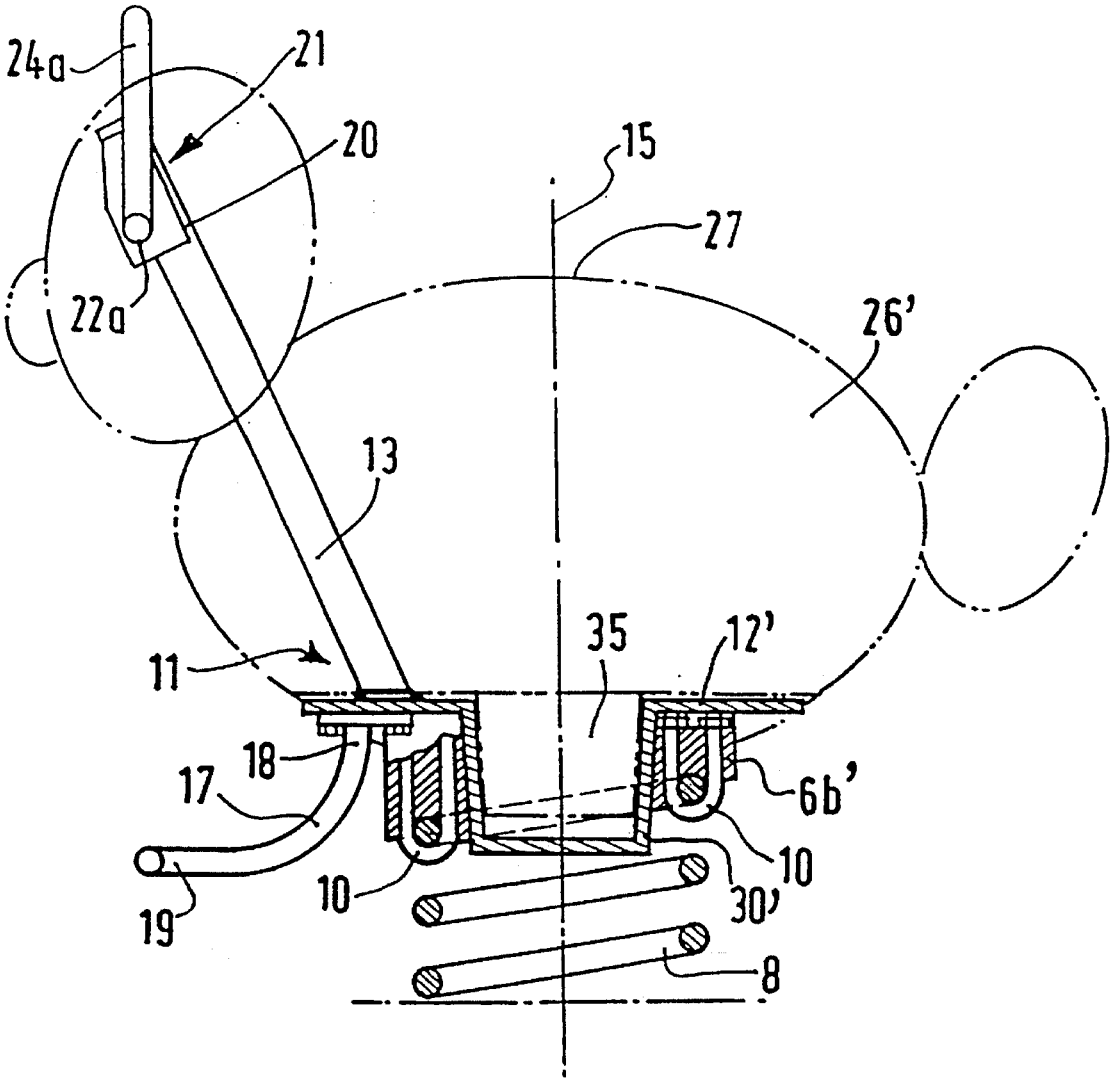
FIG. 5 is a diagrammatic side view of another embodiment of the toy on a spring according to the invention.

FIG. 5 represents a variant for fixing the foot rests 17 onto the lower face of the rectangular plate 12. In this variant, the foot rests are fixed removably, being screwed for example into tapped holes formed in the lower surface of the rectangular plate 12.

Hand grips 21 are fixed to the free upper end 20 of the branch 13. The said hand grips 21 include plates 22*a* and 22*b* which are fixed on either side of the free end 20 of the branch 13 by rivets or the like 23. The plates 22*a* and 22*b* are extended into tubes 24*a* and 24*b* in a direction perpendicular to the surface of the said plates 22*a* and 22*b*. In the examples illustrated, the hand grips 21 are removable and the rivets 23 may be coupled with holes 25 formed at different heights on the end 20 of the branch 13.

According to a variant embodiment, which is not represented, the hand grips may be rigidly fixed to the branch 13, and not removable.

A three-dimensional structure, preferably made of plastic 26, is fixed to the rectangular plate 12, and covers over the rigid reinforcement 11.

Housings, which are not represented, are formed in the three-dimensional structure 26 at the hand grips 21 so that the hand grips 21 extend out of the said three-dimensional structure 26.

The three-dimensional structure 26 covers the rectangular plate 12 and housings are also provided, if required, in the three-dimensional structure 26 to allow passage of the foot rests.

The three-dimensional structure 26 is preferably hollow and acts as a seat, on its upper part 27, for the users of the toy on a spring 1.

In the embodiment of FIG. 3, the three-dimensional structure 26 is fixed onto the periphery of the rectangular plate 12 by inserts 28 which are housed in blind holes of the three-dimensional structure 26. The connection piece 6*b* includes housings 29 on its upper part, which are intended to accommodate the head of the inserts 28.

A rigid truncated cone 30, preferably made of metal, is fixed to the upper face of the rectangular plate 12. The truncated cone 30, preferably a hollow one, is closed at its largest base 31 which is fixed to the rectangular plate 12 by rivets or the like 32, one end of which rests on the said large base 31 inside the truncated cone 30 and the other end of which rests on the bottom 33 of a housing formed at the centre of the helical surface of the connection piece 6*b*, the shank of the said rivet 32 passing through the rectangular plate 12. The truncated cone 30 is set into a housing 34 of corresponding shape, inside the three-dimensional structure 26, so that the lateral wall of the truncated cone 30 bears on the inner surface of the housing 34.

According to a variant which is not represented, the truncated cone may be replaced by a cylinder or the like which is set into a housing of corresponding shape in the three-dimensional structure. Of course, the truncated cone 30 or the cylinder may be produced as a single block with the rigid reinforcement 11.

FIG. 5 represents another embodiment of the invention in which a connection piece 6*b'* is hollowed out at its centre so that it can accommodate a hollow truncated cone 30'. The truncated cone 30' includes, on its largest base, a rectangular collar 12' which is bent over outwards, the said collar 12' resting on the upper face of the said connection piece 6*b*.

The arm 13 described previously and the foot rests 17 and a three-dimensional structure 26' are fixed to the said collar 12'. The three-dimensional structure 26' includes, at its lower part, a boss 35 of frustoconical shape, capable of being set into the truncated cone 30'. The axis of the truncated cone 30' is coincident with the axis of the spring 8 so that the said cone 30' does not interfere with the transverse oscillations of the coil spring 8.

The operation of the toy on a spring 1 according to the invention is as follows: the user sits on the upper part 27 of the three-dimensional structure. 26, and 26' respectively, his feet and his hands resting respectively on the foot rests 17 and the hand grips 21. The coil spring 8 is then slightly in compression under the effect of the weight of the user, and the inserts 28 connecting the three-dimensional structure to the reinforcement are subjected only to small loads because the lower part of the three-dimensional structure 26 rests on the rectangular plate 12 or the collar 12'. When the user rocks by causing the spring to oscillate laterally, on either side of its rest position, part of the lateral surface of the housing 34 or of the boss 35, which is in contact with the truncated cone 30 and 30' respectively, absorbs a large part of the stresses, thereby reducing the local stresses exerted on the inserts 28.

Although the invention has been described in conjunction with particular embodiments, it is quite clear that it is in no way limited thereto, and that any desirable modifications may be made to it without in any way departing from the invention's scope defined by the appended claims.

We claim:

1. A playground device on a spring including a coil spring, the lower end of which is fixed to a device for anchoring in the ground and a three-dimensional structure intended to support the user and which is fixed to the upper end of the coil spring by connection means, characterized in that said playground device comprises, inside the three-dimensional structure (26, 26'), a rigid reinforcement (11) secured to said connection means (6*b*, 6*b'*) and including a frustoconical stress-distribution piece (30, 30') at least partially set into a housing (34) formed in the three-dimensional structure (26, 26').

2. A playground device on a spring according to claim 1, characterized in that said stress-distribution piece (30, 30') has an axis (15) which is parallel to the axis of the coil spring (8) in the rest position of the coil spring, and preferably coincident with said axis of the coil spring.

3. A playground device on a spring according to claim 1, characterized in that said playground device includes hand grips (21) and foot rests (17) which are secured to the rigid reinforcement (11).

4. A playground device on a spring according to claim 3, characterized in that the hand grips (21) are removably fixed to the rigid reinforcement (11).

5. A playground device on a spring according to claim 3, characterized in that the foot rests (17) are removably fixed to the rigid reinforcement (11).

6. A playground on a spring according claim 1, characterized in that the three-dimensional structure (26, 26') is made from plastic as a single block.

7. A playground device on a spring according to claim 6, characterized in that the three-dimensional structure (26, 26') is rotationally molded.

8. A playground device on a spring according to claim 1, said frustoconical stress-distribution piece (30, 30') set onto a boss (35) of corresponding shape formed in a lower end of the three-dimensional structure (26, 26').

* * * * *